US006991534B2

(12) United States Patent
Koessler

(10) Patent No.: US 6,991,534 B2
(45) Date of Patent: Jan. 31, 2006

(54) ADJUSTABLE VENT

(76) Inventor: Juergen Koessler, 2051 West 19th Avenue, Vancouver, BC (CA) V6J 2P5

( * ) Notice: Subject to any disclaimer, the term of this patent is extended or adjusted under 35 U.S.C. 154(b) by 0 days.

(21) Appl. No.: 10/815,745

(22) Filed: Apr. 2, 2004

(65) Prior Publication Data

US 2005/0227609 A1 Oct. 13, 2005

(51) Int. Cl.
*F24F 13/062* (2006.01)

(52) U.S. Cl. ..... 454/300; 454/303; 454/312

(58) Field of Classification Search ..... 454/300, 454/302, 303, 310, 311, 312
See application file for complete search history.

(56) References Cited

U.S. PATENT DOCUMENTS 2,365,867 A * 12/1944 Dauphinee ..... 454/311
3,063,356 A * 11/1962 Fitt ..... 454/312
3,103,869 A * 9/1963 Dry ..... 454/302
3,107,597 A * 10/1963 Person ..... 454/300
3,155,027 A * 11/1964 Dayus ..... 454/311
3,717,081 A * 2/1973 Jakimas ..... 454/312
5,133,693 A * 7/1992 Blomster ..... 454/312

* cited by examiner

*Primary Examiner*—Harold Joyce
(74) *Attorney, Agent, or Firm*—Oyen Wiggs Green & Mutala LLP

(57) ABSTRACT

One aspect of the invention provides a vent which comprises a body member and an adjustment member. The body member comprises a vent passageway that extends from an inward side to an outward side of the body member. The body member also comprises a collar having a collar passageway that extends from an inward side to an outward side of the collar. The collar passageway is in fluid communication with the vent passageway. The adjustment member comprises a head disposed to adjustably restrict a flow of air through the vent passageway and an inwardly projecting stem having one or more stem portions. The one or more stem portions comprise one or more contact portions which engage an interior surface of the collar and which adjustably couple the adjustment member to the body member. The one or more stem portions, alone or in combination with the interior surface of the collar, define one or more collar openings that extend through the collar passageway. Air flowing through the vent may flow through the collar openings.

38 Claims, 10 Drawing Sheets

ADJUSTABLE VENT

TECHNICAL FIELD

The invention pertains to vents. Particular embodiments of the invention relate to adjustable vents which may be mounted on building surfaces.

BACKGROUND

Many buildings have vents which provide routes for exchange, ventilation, circulation and/or movement of air through the surfaces (eg. walls and ceilings) of the building. Buildings may have ventilation systems, which take in "fresh" air from outside of the building and expel "stale" air from inside the building. Fresh air may be taken into a building or stale air may be expelled from a building through one or more vents. Some buildings incorporate other systems and/or apparatus, such as air conditioning systems, heating systems and bathroom fans, which use vents to provide routes for the movement of air through building surfaces.

Typically, a vent is associated with a conduit which conveys air towards or away from the vent. A vent provides a vent passageway in fluid communication with its associated conduit to provide a means for air flow through a building surface. Vents may provide a number of additional functions. For example, vents may comprise features for preventing debris from entering their associated conduits or for providing a more aesthetically pleasing terminus for their associated conduits.

There are many vent designs known in the art. For example:

- U.S. Pat. No. 6,520,852 (McKee et al.) discloses a vent with a perimeter flange having a nailing means made of a material with a low coefficient of thermal expansion, such as aluminum. The vent further includes a grill structure and a cap. The cap, which is made from dent resistant plastic, is preferably molded to the nailing means;
- U.S. Pat. No. 5,6435081 (Klein) describes a vent screen and vent, which include a vent duct, an exterior grill connected to one end of the vent duct, and a vent screen support assembly connected between the vent duct and the exterior grill; and
- U.S. Pat. No. 6,682,415 (Vagedes) discloses a replacement dryer vent which includes a typical exterior vent portion and an interior tube portion. The tube portion extends into a building and has an internal diameter that increases toward its innermost edge (i.e. toward the interior of the building), such that the tube portion slips over the existing cylindrical duct already in the wall.

Vents typically comprise a flange or the like, which allows the vent to be mounted to a building surface using fasteners that project through the flange and into the building surface. Exposed fasteners used for this purpose may make the vent aesthetically unattractive. Exposed fasteners may also be susceptible to oxidation or similar consequences of being exposed to the environment.

Some vents comprise flow adjustment mechanisms. Such mechanisms allow the flow of air through the vent to be controlled. Because of frequent use and the associated wear, flow adjustment mechanisms used in vents often malfunction or break. Accordingly, there is a general desire to provide vents with flow adjustment mechanisms that are robust and relatively immune to breakage. Vents incorporating such robust flow adjustment mechanisms typically require that the flow adjustment mechanisms and their associated components are relatively large to provide the flow adjustment mechanisms with sufficient strength.

One drawback with such robust flow adjustment mechanisms is that the maximum rate of air flow through a vent and its conduit will typically be limited by the cross-sectional area of the conduit and/or the vent. Robust and correspondingly large flow adjustment mechanisms tend to occupy a larger portion of the vent and to impede the flow of air through the vent.

There is a need for vents which have relatively robust and strong flow adjustment mechanisms that do not unnecessarily impede the flow of air through the vent. There is also a need for vents which are attractive looking.

SUMMARY OF THE INVENTION

A first aspect of the invention provides a vent which comprises a body member and an adjustment member. The body member comprises a vent passageway that extends from an inward side to an outward side of the body member. The body member also comprises a collar having a collar passageway that extends from an inward side to an outward side of the collar. The collar passageway is in fluid communication with the vent passageway. The adjustment member comprises a head disposed to adjustably restrict a flow of air through the vent passageway and a stem. The stem, which may project inwardly from the head, has one or more stem portions. The one or more stem portions comprise one or more contact portions which engage an interior surface of the collar and which moveably couple the adjustment member to the body member. The one or more stem portions, alone or in combination with the interior surface of the collar, define one or more collar openings that extend through the collar passageway.

A position of the adjustment member may be adjustable relative to the body member to adjustably restrict the flow of air through the vent passageway. At least a portion of the flow of air through the vent passageway may flow through the one or more collar openings. One or more of the collar opening(s) may be defined between at least one stem portion and the interior surface of the collar. One or more of the collar opening(s) may be defined between a plurality of stem portions.

Inward movement of the adjustment member relative to the body member may decrease a size of an opening through which air may flow into and out of the vent passageway. Conversely, outward movement of the adjustment member relative to the body member may increase the size of the opening through which air may flow into and out of the vent passageway.

The one or more stem portions may have a wide variety of configurations. The one or more stem portions may comprise one or more blades and the one or more contact portions may comprise a plurality of contact portions that engage the interior surface of the collar at spaced-apart locations. The one or more blades may comprise a plurality of blades which extend radially in angularly spaced-apart directions. The angularly spaced-apart directions may be equally spaced from one another. The one or more blades may have different configurations. Each collar opening may be defined between two or more blades and/or between one or more blades and the interior surface of the collar.

The interior surface of the collar may be generally circular in cross-section and may comprise one or more helical threads. The one or more contact portions may comprise at least one contact portion that has one or more indents for engaging the one or more helical threads. Rotating the adjustment member relative to the body member in a first angular direction may cause corresponding inward movement of the adjustment member relative to the body member and a corresponding decrease in a size of an opening through which air may flow into and out of the vent passageway. Conversely, rotating the adjustment member relative to the body member in a second angular direction may cause corresponding outward movement of the adjustment member relative to the body member and a corresponding increase in the size of the opening through which air may flow into and out of the vent passageway.

The one or more contact portions may slidably frictionally engage the interior surface of the collar. The one or more stem portions may comprise one or more contact portions that abut against the interior surface of the collar to form a slidable friction fit therewith. The interior surface of the collar may comprise one or more inwardly extending grooves and the one or more contact portions may comprise at least one contact portion that is slidably received in each of the grooves. The interior surface of the collar may comprise one or more projections and the one or more contact portions may comprise at least one inwardly extending groove which slidably receives the one or more projections.

The body member may comprise one or more brackets for supporting the collar in the vent passageway.

The vent may comprise one or more intermediate members that may be coupled between the body member and the adjustment member. Each intermediate member may comprise an intermediate vent passageway that extends from an inward side to an outward side of the intermediate member and an intermediate member collar having an intermediate collar passageway that extends from an inward side to an outward side of the intermediate member collar. Each intermediate collar passageway may be in fluid communication with the intermediate vent passageway. Preferably, at least a portion of each intermediate member collar is supported in its corresponding intermediate vent passageway. The one or more contact portions of the adjustment member may engage an interior surface of each intermediate member collar and may adjustably couple each intermediate member between the adjustment member and the body member. The one or more stem portions, alone or in combination with the interior surface of each intermediate member collar, may define one or more intermediate collar openings that extend through each intermediate collar passageway.

Air passing through the vent passageway may flow inwardly and/or outwardly through the intermediate collar openings. Each intermediate member may move inwardly and outwardly relative to the body member and/or the adjustment member to decrease or increase the size of the openings through which air may flow into and out of the vent passageway and each corresponding intermediate vent passageway.

One or more of the intermediate collar opening(s) may be defined between at least one stem portion and the interior surface of the intermediate member collar. One or more of the intermediate collar opening(s) may be defined between a plurality of stem portions.

The interior surface of each intermediate member collar may be generally circular in cross-section and may comprise one or more helical threads. The one or more contact portions may comprise at least one contact portion that has one or more indents for engaging the one or more helical threads. Rotating the adjustment member relative to an intermediate member in a first angular direction may cause corresponding inward movement of the adjustment member relative to the intermediate member and a corresponding decrease in a size of an opening through which air may flow into and out of the intermediate vent passageway and rotating the adjustment member relative to the intermediate member in a second angular direction may cause corresponding outward movement of the adjustment member relative to the intermediate member and a corresponding increase in the size of the opening through which air may flow into and out of the intermediate vent passageway.

Rotating the intermediate member relative to the body member in a first angular direction may cause corresponding inward movement of the intermediate member relative to the body member and a corresponding decrease in a size of an opening through which air may flow into and out of the vent passageway and rotating the intermediate member relative to the body member in a second angular direction may cause corresponding outward movement of the intermediate member relative to the body member and a corresponding increase in the size of the opening through which air may flow into and out of the vent passageway.

The body member may comprise a mounting flange for coupling the body member to a building surface. When the vent is mounted to the building surface, a plurality of fasteners may project through the mounting flange and into the building surface. The vent may comprise a trim member that is removably coupleable to the body member. When the trim member is coupled to the body member, the trim member may extend over an outward surface of the mounting flange at a distance spaced outwardly therefrom. The trim member may cover an outward side of any portions of the plurality of fasteners which extend outwardly past the outward surface of the mounting flange. The trim member may be shaped to define a channel and, when the trim member is coupled to the body member, the channel may open inwardly onto the outward surface of the mounting flange such that any portions of the plurality of fasteners which extend outwardly past the outward surface of the mounting flange are located in the channel.

The vent may comprise a trim member that is removably coupleable to the body member, wherein, when the trim member is coupled to the body member, the trim member covers outward ends of one or more fasteners used to mount the vent to the building surface. The trim member may comprise an interiorly projecting lip and the body member may comprise an exteriorly projecting lip. When the trim member is coupled to the body member, the interiorly projecting lip of the trim member may be received on an inward side of the exteriorly projecting lip of the body member. The trim member may comprise at least one groove and the body member may comprises at least one projection. When the trim member is coupled to the body member, the at least one projection may be received in the at least one groove.

Another aspect of the invention provides a vent that comprises a body member and an adjustment member. The body member has a vent passageway which extends from an inward side to an outward side of the body member and a surface that defines a bore in fluid communication with the vent passageway. The adjustment member comprises a head and a stem projecting inwardly from the head. The stem comprises a plurality of blades. The exterior edges of the blades are disposed to engage the bore defining surface. The blades, alone or in combination with the bore defining surface, define a plurality of passages through the bore.

The bore defining surface may comprise one or more helical threads and the exterior edge of at least one of the blades may comprise one or more indents for engaging the one or more threads.

Another aspect of the invention provides a vent comprising a body member and an adjustment member. The body member comprises a vent passageway that extends from an inward side to an outward side of the body member. The body member also comprises a collar. An interior surface of the collar defines a collar passageway which is in fluid communication with the vent passageway. The adjustment member comprises a head disposed to adjustably restrict a flow of air through the vent passageway and a stem that projects inwardly from the head. The stem has one or more stem portions. The one or more stem portions comprise one or more contact portions which engage an interior surface of the collar and which couple the adjustment member to the body member, such that the stem projects inwardly into the collar passageway and the adjustment member is inwardly and outwardly moveable relative to the body member. The one or more stem portions, alone or in combination with the interior surface of the collar, define one or more collar openings that extend through the collar passageway for permitting a flow of air through the collar passageway.

Another aspect of the invention provides a vent. The vent comprises a body member that defines a vent passageway. The vent also comprises a collar that defines a collar passageway. The collar is supported to provide fluid communication between the vent passageway and the collar passageway. The vent also comprises an adjustment member, coupling means for moveably coupling the adjustment member to the collar and passage means for permitting air flow through the collar passageway while the adjustment member is coupled to the collar by the coupling means.

Further aspects of the invention, features of specific embodiments of the invention and applications of the invention are described below.

BRIEF DESCRIPTION OF THE DRAWINGS

In drawings which depict non-limiting embodiments of the invention.

DETAILED DESCRIPTION

Figure 1:
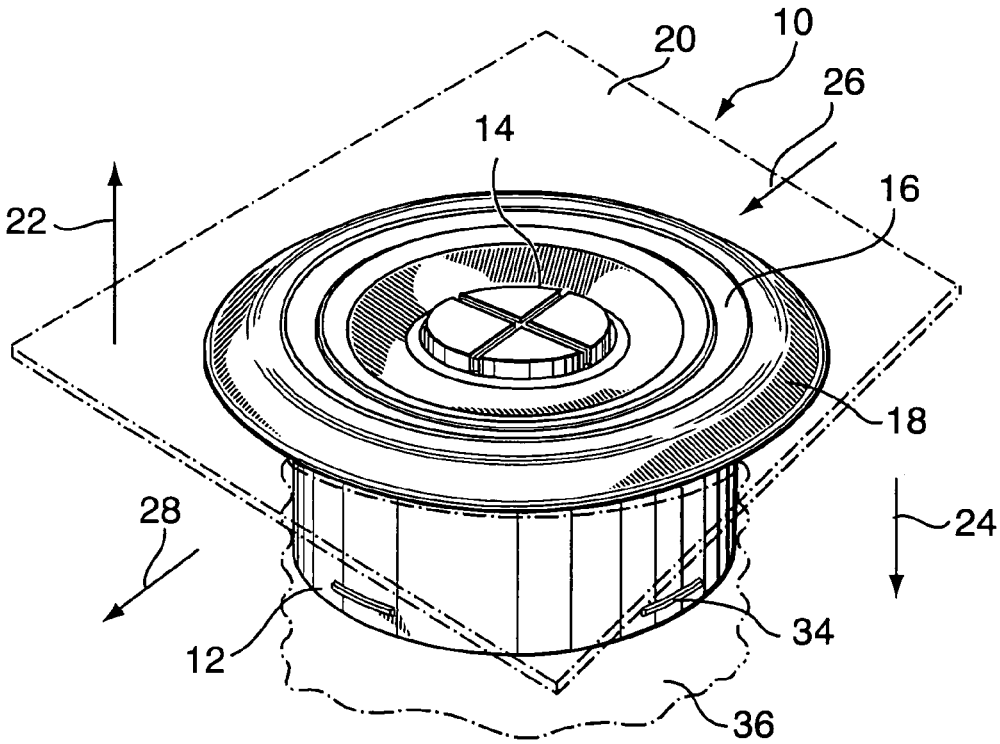
FIG. 1 is an isometric view of an adjustable vent according to a particular embodiment of the invention in a closed configuration.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of this invention relate to adjustable vents that can be used to provide passages for air through building surfaces. For example, vents according to the invention may be used for bathroom or kitchen fans, air conditioning ducts, heating ducts or the like.

Vents according to some embodiments of the invention have a body member comprising a vent passageway that extends from an inward side to an outward side of the body member. Preferably, the body member is mountable to a building surface. The body member also comprises a collar having a collar passageway that extends from an inward side to an outward side of the collar. The collar passageway is in fluid communication with the vent passageway. Preferably, at least a portion of the collar is supported in the vent passageway.

An adjustment member, which comprises a head disposed to adjustably restrict a flow of air through the vent passageway and a stem. The stem, which may project inwardly from the head, comprises one or more stem portions. The stem portion(s) comprise one or more contact portions which engage an interior surface of the collar and which moveably couple the adjustment member to the body member. The stem portion(s), alone or in combination with the interior surface of the collar, define one or more collar openings that extend through the collar passageway. A position of the adjustment member may be adjustable relative to the body member to adjustably restrict the flow of air through the vent passageway. The collar opening(s) may be defined between two or more stem portions and/or between one or more stem portions and the interior surface of the collar. Air passing through the vent passageway may flow inwardly and/or outwardly through the collar opening(s).

The adjustable vent may also comprise one or more intermediate members that may be coupled between the body member and the adjustment member. Each intermediate member may comprise an intermediate vent passageway and an intermediate member collar having an intermediate collar passageway. The stem portion(s) of the adjustment member, alone or in combination with the interior surface of the intermediate member collar, also define one or more intermediate collar openings that extend through each intermediate collar passageway. A position of each intermediate member may be inwardly and outwardly adjustable relative to the adjustment member and the body member to increase or decrease the size of the openings through which air may flow into and out of the vent passageway.

The body member may comprise a mounting flange for coupling the body member to a building surface. The vent may also comprise a trim member, which is coupleable to the body member (or to some other component of the vent). The trim member may cover fasteners used to mount the vent to a building surface. In some embodiments, the trim member extends over at least a portion of an outward surface of the mounting flange at a distance spaced-apart therefrom and covers any portions of the fasteners that extend on the outward side of the mounting flange.

FIGS. 1–10 depict a vent 10 according to a particular embodiment of the invention. In most applications, vent 10 is mounted to a building surface 20 (shown in broken lines in FIG. 1). Building surface 20 may generally be a ceiling, a wall, a floor or any other building surface and may be in the interior of the building or on the exterior of the building. In the illustrated embodiment, vent 10 comprises a body member 12, an adjustment member 14, an optional intermediate member 16 and an optional trim member 18. Vent 10 is shown to be generally circular in shape. In alternative embodiments, vents according to the invention may have different shapes. By way of example only, vents according to the invention may be rectangular or partially rectangular and partially circular.

This description and the accompanying claims use a number of directional conventions to clarify their meaning:

(i) "outward ", "outwardly", "outwardmost" and similar words are used to refer to a direction that is generally oriented to extend away from building surface 20 as shown by arrow 22 (FIG. 1);

(ii) "inward", "inwardly", "inwardmost" and similar words are used to refer to a direction that is generally oriented toward the inside of building surface 20 as shown by arrow 24 (FIG. 1);

(iii) "interior", "interiorly", "interiormost" and similar words are used to refer to directions that are generally oriented toward the symmetrical center of vent 10, as shown, for example, by arrow 26 (FIG. 1); and (iv) "exterior", "exteriorly", "exteriormost" and similar words are used to refer to directions that are generally oriented away from the symmetrical center of vent 10, as shown, for example, by arrow 28 (FIG. 1).

Those skilled in the art will appreciate that directional terms used in this description and the accompanying claims depend on the specific orientation of vent 10 and building surface 20 to which vent 10 is mounted. Furthermore, as described above, vent 10 need not be circularly symmetric and may have other symmetrical or non-symmetrical shapes. Accordingly, these directional terms are not strictly defined and should not be interpreted literally or narrowly.

Figure 3:
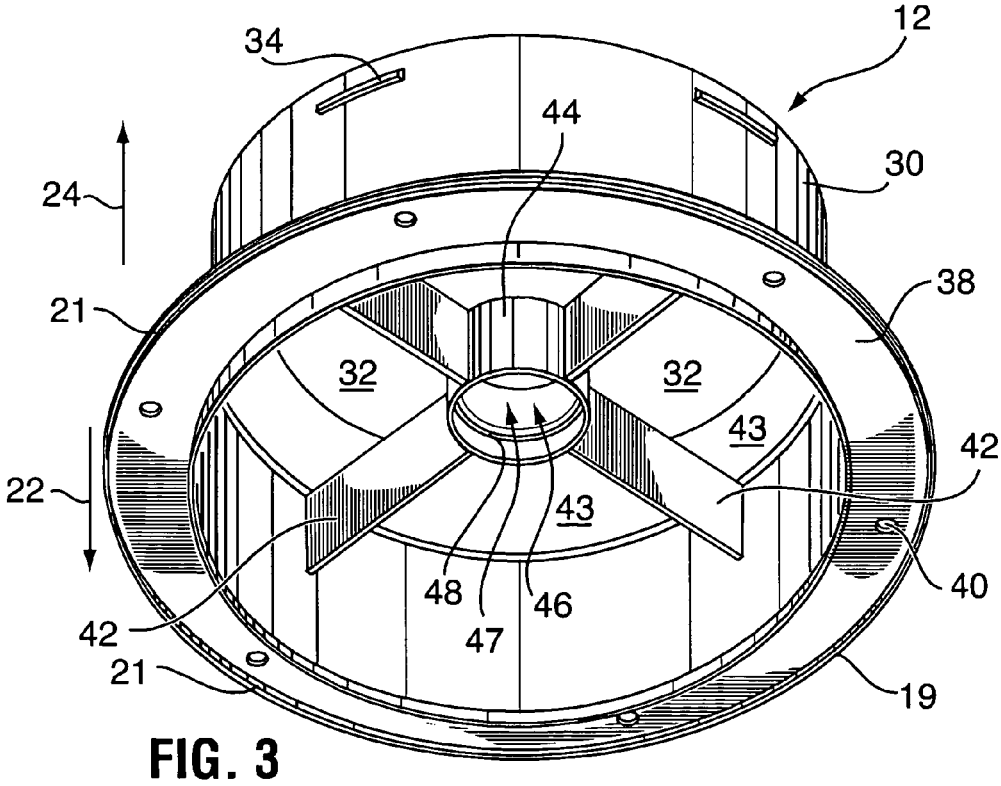
FIG. 3 is an isometric view of a body member of the FIG. 1 vent.
Figure 4:
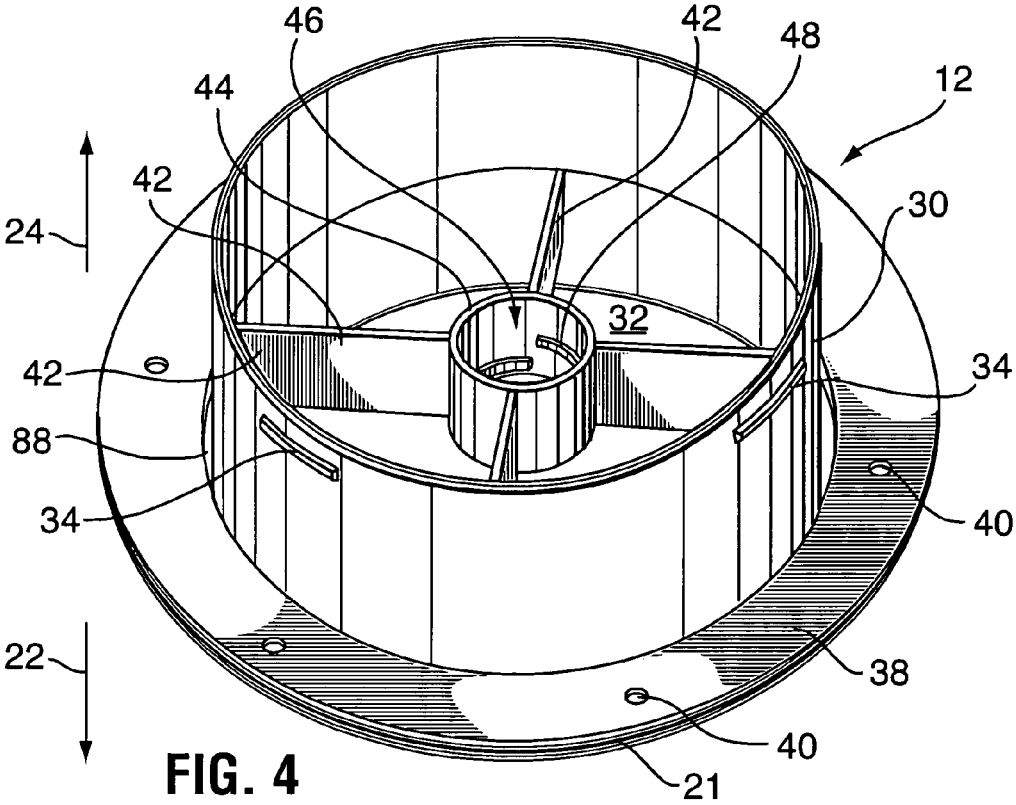
FIG. 4 is an isometric view of the body member of FIG. 3 from a different perspective.

As shown best in FIGS. 1, 3 and 4, body member 12 comprises a first flange 30 which extends inwardly into building surface 20 (FIG. 1). In the illustrated embodiment, an interior surface of first flange 30 defines a vent passageway 32. Vent passageway 32 is an aperture which extends from an inward side to an outward side of body member 12 to facilitate the passage of air through vent 10.

Body member 12 also comprises a collar 44 which defines a collar passageway 47. Collar passageway 47 extends from an inward side to an outward side of collar 44 and is in fluid communication with vent passageway 32. In the illustrated embodiment, collar 44 is supported by plurality of angularly spaced-apart brackets 42, which extend interiorly from an interior surface of first flange 30 into vent passageway 32. Preferably, at least a portion of collar 44 is located in vent passageway 32. Brackets 42 are preferably spaced-apart from one another to provide passages 43 (FIG. 3), which permit air flow through vent passageway 32. In the illustrated embodiment, collar 44 is supported by four brackets 42; however, body member 12 may comprise an alternative number of brackets 42 or any alternative means for supporting collar 44 such that collar passageway 47 is in fluid communication with vent passageway 32.

Vent 10 also comprises an adjustment member 14 (shown best in FIG. 5), which may be coupled to body member 12 and disposed to adjustably restrict the flow of air through vent passageway 32. Adjustment member 14 comprises an inwardly extending stem 52 and a generally exteriorly extending head 58.

Stem 52 of adjustment member 14 comprises one or more stem portions 53. Stem portion(s) 53 comprise one or more contact portions 55 which engage the interior surface of collar 44 to adjustably couple adjustment member 14 to body member 12 in a manner that facilitates inward and outward movement of adjustment member 14 relative to body member 12. Stem portion(s) 53 define one or more collar openings 51 (FIG. 2) that extend through collar passageway 47. Collar opening(s) 51 may be defined between two or more stem portions 53 and/or between one or more stem portions 53 and the interior surface of collar 44. Air passing through vent 10 may flow inwardly and/or outwardly through collar opening(s) 51.

Head 58 of adjustment member 14 extends generally exteriorly from stem 52. The exterior extension of head 58 tends to restrict the flow of air through the outward end of vent passageway 32. Inward movement of adjustment member 14 relative to body member 12 causes head 58 to move closer to body member 12, thereby decreasing the size of the opening through which air may flow into and out of vent passageway 32. Conversely, outward movement of adjustment member 14 relative to body member 12 causes head 58 to move further from body member 12, thereby increasing the size of the opening through which air may flow into and out of vent passageway 32.

Stem portion(s) 53 of adjustment member 14 may have a wide variety of configurations. The illustrated embodiment of adjustment member 14 comprises a plurality of stem portions 53A, 53B, 53C, 53D (collectively, stem portions 53) which, in turn, comprise a plurality of contact portions 55A, 55B, 55C, 55D (collectively 55). Contact portions 55 engage the interior surface of collar 44 at spaced-apart locations. Collar openings 51 are defined between pairs of stem portions 53 and the interior surface of collar 44. Collar openings 51 extend through collar passageway 47.

In the illustrated embodiment, stem portions 53 comprise blades 50A, 50B, 50C, 50D (collectively 50), which extend radially at angularly spaced-apart locations. In the embodiment of FIGS. 1–10, adjustment member 14 comprises four blades 50, which are symmetrically angularly spaced-apart from one another about axis 60 of stem 52. Each blade 50 comprises a contact portion 55 at its exterior end. Adjustment member 14 may comprise a different number of blades 50, which may be angularly spaced-apart from one another by different angular separations that may or may not be symmetric. In some embodiments, one or more of blades 50 do not comprise contact portions 55 (i.e. one or more of blades 50 do not contact the interior surface of collar 44). In still other embodiments, blades 50 have other configurations.

Advantageously, stem portions 53, collar 44 and head 58 provide a robust air flow adjustment mechanism, the components of which may be made sufficiently large and correspondingly strong to be relatively immune from breakage. In addition, the collar openings 51 that extend through collar passageway 47 minimize the blockage of vent passageway 32 by the components of the flow adjustment mechanism, thereby permitting a wide range of air flow through vent passageway 32 and vent 10. In particular, the presence of collar openings 51 permits the flow of air through collar passageway 47, such that collar passageway 47 (i.e. the interior of collar 44) may be an effective part of vent passageway 32. In some embodiments of the invention, a combined cross-sectional area of collar openings 51 is at least 50% of the cross-sectional area of collar passageway 47. In other embodiments, a combined cross-sectional area of collar openings 51 is at least 75% of the cross-sectional area of collar passageway 47.

In some embodiments of the invention, the interior surface of collar 44 is generally circular in cross-section and comprises one or more helical threads 48, thereby defining a threaded bore 46. In such embodiments, one or more contact portions 55 of stem portion(s) 53 comprise one or more indents 56 for engaging helical thread(s) 48. In the illustrated embodiment, the contact portion 55 on the exterior end of each blade 50 comprises a plurality of indents 56 for engaging helical thread(s) 48. In these embodiments, rotating adjustment member 14 relative to body member 12 causes corresponding inward or outward movement of adjustment member 14 relative to body member 12 and a corresponding decrease or increase in the size of the opening through which air may flow through vent passageway 32.

Figure 6:
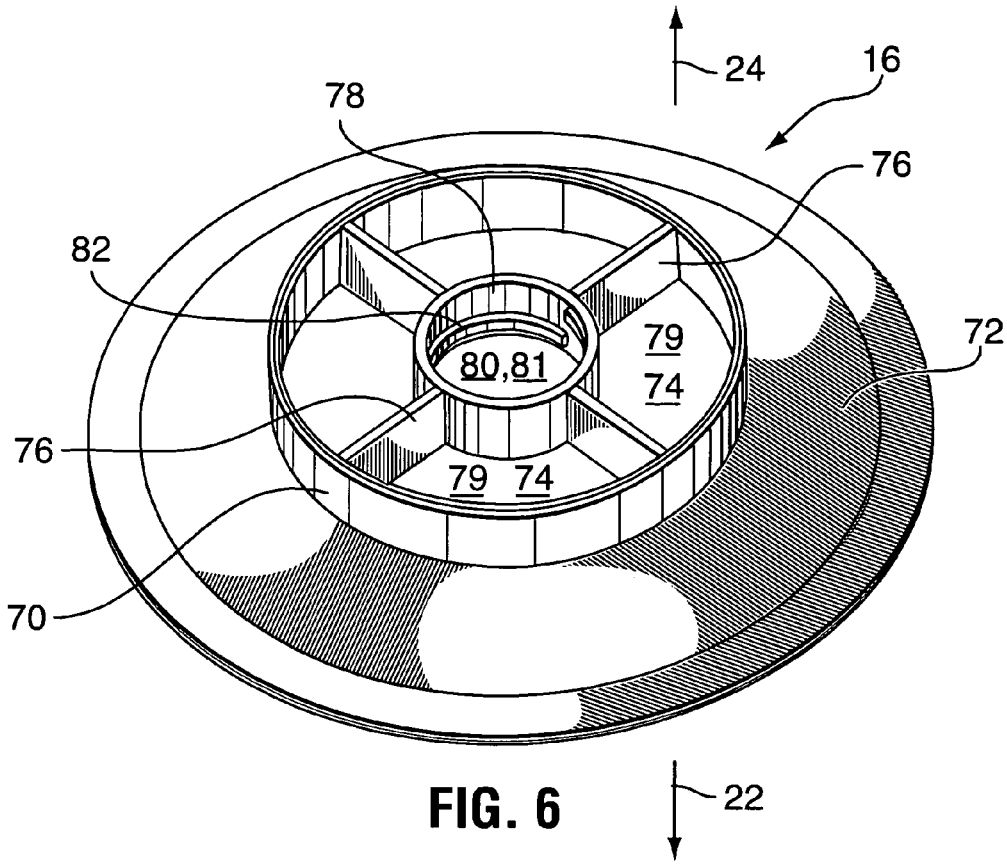
FIG. 6 is an isometric view of an intermediate member of the FIG. 1 vent.
Figure 7:
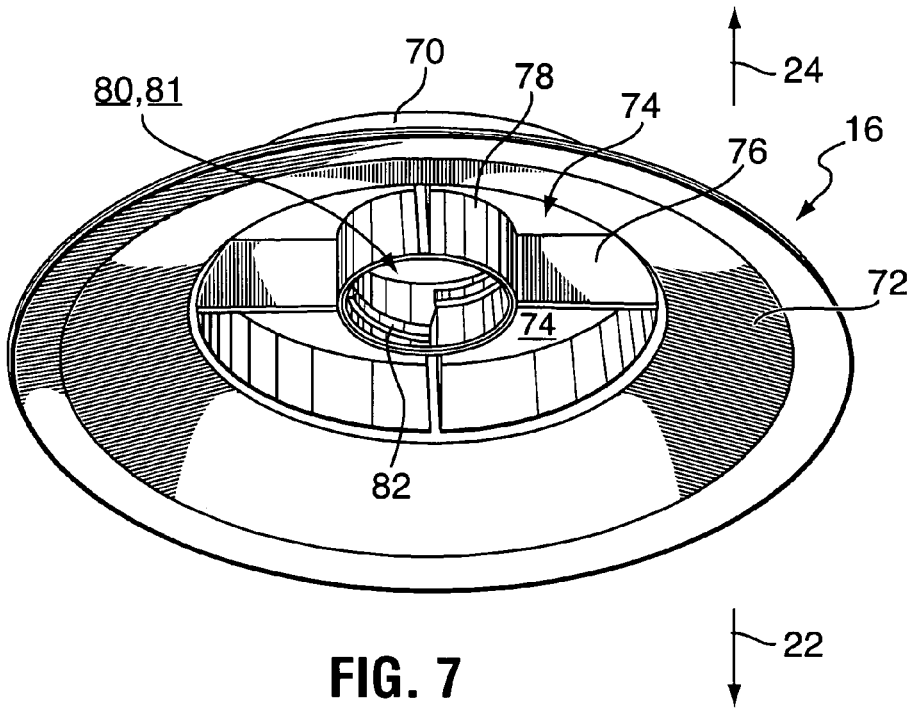
FIG. 7 is an isometric view of the intermediate member of FIG. 6 from a different perspective.

In the illustrated embodiment, vent 10 also comprises an optional intermediate member 16, which is shown best in FIGS. 6 and 7. Intermediate member 16 may be coupled between adjustment member 14 and body member 12. Intermediate member 16 comprises a first intermediate flange 70 that defines an intermediate vent passageway 74. Intermediate vent passageway 74 extends from an inward side to an outward side of intermediate member 16 to facilitate the passage of air therethrough. In the illustrated embodiment, intermediate vent passageway 74 is circular in cross-section. In other embodiments, intermediate vent passageway 74 may have other cross-sectional shapes.

Figure 2:
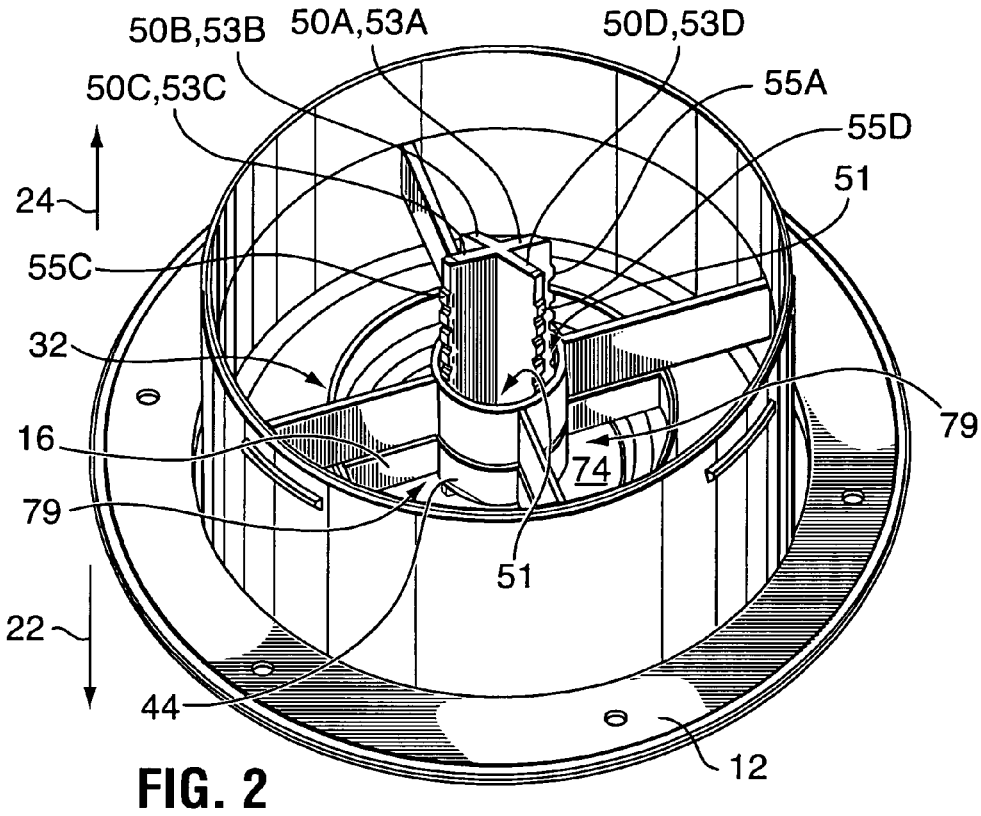
FIG. 2 is an isometric view of the FIG. 1 vent from a different perspective.

Intermediate member 16 is preferably positioned such that intermediate vent passageway 74 is in fluid communication with vent passageway 32 of body member 12 (see FIG. 2). The cross-sectional areas of first intermediate flange 70 and intermediate vent passageway 74 of intermediate member 16 may be less than the cross-sectional areas of first flange 30 and vent passageway 32 of body member 12, such that intermediate member 16 can be used to restrict the flow of air through vent 10 as explained further below.

Intermediate member 16 comprises an intermediate member collar 78 which defines an intermediate collar passageway 81. Intermediate collar passageway 81 extends from an inward side to an outward side of intermediate member collar 78. Intermediate collar passageway 81 is in fluid communication with intermediate vent passageway 74. In the illustrated embodiment, intermediate member collar 78 is supported by a plurality of angularly spaced-apart brackets 76, which extend interiorly from an interior surface of first intermediate flange 70 into intermediate vent passageway 74. Preferably, at least a portion of intermediate member collar 78 is located in intermediate vent passageway 74. Brackets 76 are preferably spaced-apart from one another to provide passages 79 (FIG. 6), which permit air flow through intermediate vent passageway 74. In the illustrated embodiment, intermediate member collar 78 is supported by four brackets 76; however, intermediate member 16 may comprise an alternative number of brackets 76 or any alternative means for supporting intermediate member collar 78 such that intermediate collar passageway 81 is in fluid communication with intermediate vent passageway 74.

Preferably, as shown in the illustrated embodiment, intermediate member 16 is aligned with body member 12, such that intermediate member collar 78 is aligned with body member collar 44. Stem 52 of adjustment member 14 may extend inwardly through the interior of both intermediate member collar 78 and body member collar 44. Contact portion(s) 55 of stem portion(s) 53 of adjustment member 14 may engage the interior surfaces of both intermediate member collar 78 and body member collar 44 to couple intermediate member 16 between body member 12 and adjustment member 14 in a manner which facilitates independent inward and outward movement of intermediate member 16 and adjustment member 14 with respect to body member 12.

The one or more stem portions 53 of adjustment member 14 also define one or more intermediate collar openings (not shown in the illustrated views) that extend through intermediate collar passageway 81. The one or more intermediate collar openings may be defined between two or more stem portions 53 and/or between one or more stem portions 53 and the interior surface of intermediate member collar 78. Air passing through vent 10 may flow inwardly and/or outwardly through these intermediate collar openings (i.e. through intermediate collar passageway 81).

In the illustrated embodiment, both intermediate member 16 and adjustment member 14 may be moved inwardly and outwardly relative to body member 12. This relative movement between adjustment member 14, intermediate member 16 and body member 12 determines the size of opening 84 (FIG. 1A) between adjustment member 14 and intermediate member 16 and the size of opening 86 (FIG. 1A) between intermediate member 16 and body member 12. Opening 84 permits the flow of air into and out of the outward ends of vent passageway 32 and intermediate vent passageway 74. Opening 86 bypasses intermediate vent passageway 74 and permits the flow of air into and out of the outward end of vent passageway 32.

Figure 1A:
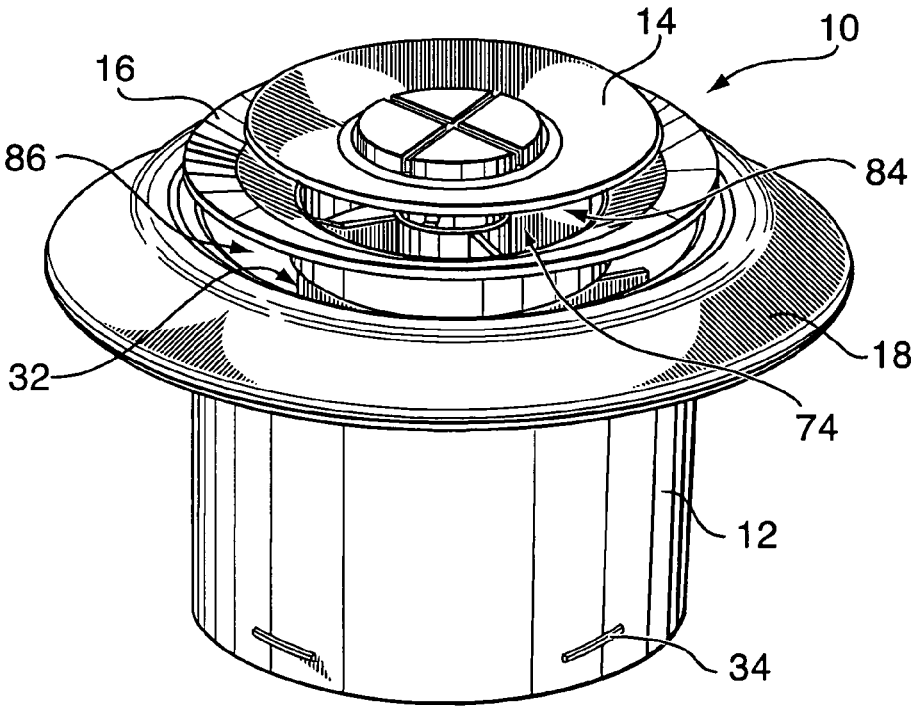
FIG. 1A is an isometric view of the FIG. 1 vent in an open configuration.

Referring to FIG. 1A, adjustment member 14 may be independently moved outwardly (or inwardly) relative to both intermediate member 16 and body member 12 to cause a corresponding increase (or decrease) in the size of opening 84. Similarly, intermediate member 16 may be independently moved relative to both body member 12 and adjustment member 14. Intermediate member 16 may be moved outwardly (i.e away from body member 12 and toward adjustment member 14) to cause a corresponding increase in the size of opening 86 and a corresponding decrease in the size of opening 84. Intermediate member 16 may also be moved inwardly (i.e toward body member 12 and away from adjustment member 14) to cause a corresponding decrease in the size of opening 86 and a corresponding increase in the size of opening 84. Intermediate member 16 and adjustment member 14 may also be moved together in an outward (or inward) direction relative to body member 12 to cause a corresponding increase (or decrease) in the size of opening 86.

In the illustrated embodiment, the interior surface of intermediate member collar 78 is generally circular in cross-section and comprises one or more helical threads 82, thereby defining a threaded bore 80. Preferably, at least the interior surface of intermediate member collar 78 is substantially similar in size to the interior surface of body member collar 44. In addition, the pattern of thread(s) 82 on the interior surface of intermediate member collar 78 is preferably similar to that of thread(s) 48 on the interior surface of body member collar 44.

As discussed above, one or more contact portions 55 of stem portion(s) 53 of adjustment member 14 may comprise one or more indents 56. Indent(s) 56 may engage helical thread(s) 82 on intermediate member collar 78 and helical thread(s) 48 on body member collar 44. With this configuration, adjustment member 14 may be independently rotated relative to body member 12 and intermediate member 16 to cause corresponding inward or outward movement of adjustment member 14 relative to body member 12 and intermediate member 16 and a corresponding decrease or increase in the size of opening 84. Similarly, intermediate member 16 may be independently rotated relative to body member 12 and adjustment member 14 to cause corresponding inward movement of intermediate member 16 relative to body member 12 and adjustment member 14, a corresponding increase in the size of opening 84 and a corresponding decrease in the size of opening 86. Intermediate member 16 may also be rotated in the opposite angular direction relative to body member 12 and adjustment member 14 to cause corresponding outward movement of intermediate member 16 relative to body member 12 and adjustment member 14, a corresponding decrease in the size of opening 84 and a corresponding increase in the size of opening 86. Intermediate member 16 and adjustment member 14 may also be rotated together relative to body member 12 to cause corresponding inward or outward movement of intermediate member 16 and adjustment member 14 relative to body member 12 and a corresponding decrease or increase in the size of opening 86.

In some embodiments of the invention, as shown best in FIGS. 1–4, the exterior surface of first flange 30 of body member 12 comprises one or more exteriorly extending protrusions 34 and/or interiorly extending indents (not shown), which may be used to couple first flange 30 to the interior wall(s) of a conduit 36 (shown in dotted outline in FIG. 1) located within building surface 20 and/or to retain conduit 36 in fluid communication with vent passageway 32. In other embodiments, first flange 30 has similar coupling features on its interior surface. In still other embodiments, first flange 30 and vent passageway 32 are located in a position proximate to conduit 36 to facilitate fluid communication therebetween.

In the illustrated embodiment, the interior surface of first flange 30 and vent passageway 32 are generally circular in cross-section. Those skilled in the art will appreciate that this circular shape merely represents one among many possible shapes of first flange 30. A particular size and/or shape of first flange 30 may be selected to conform with the size and/or shape of conduit 36. For example, first flange 30 may be square or rectangular in cross-section.

In some embodiments of the invention, as shown best in FIGS. 1, 2 and 3, body member 12 also comprises an exteriorly extending mounting flange 38 which may be used to mount vent 10 to building surface 20. Preferably, at least a portion of the inward surface of mounting flange 38 extends generally parallel with the plane of building surface 20. In this manner, first flange 30 may extend inwardly into building surface 20 and mounting flange 38 may abut against building surface 20 for mounting thereto. In the illustrated embodiment, mounting flange 38 comprises a plurality of spaced-apart apertures 40. Fasteners (not shown) may be inserted through apertures 40, so as to project through mounting flange 38 and into building surface 20 for mounting vent 10 to building surface 20. Typical fasteners may include screws, nails, rivets, staples or the like. In some embodiments, apertures 40 are not required and fasteners may be driven directly through mounting flange 38 and into building surface 20. In other embodiments, adhesive may be used to couple mounting flange 38 to building surface 20. In still other embodiments, first flange 30 is used to mount vent 10 to building surface 20 using a friction fit. Such friction fitted embodiments may or may not have a mounting flange 38.

Figure 10:
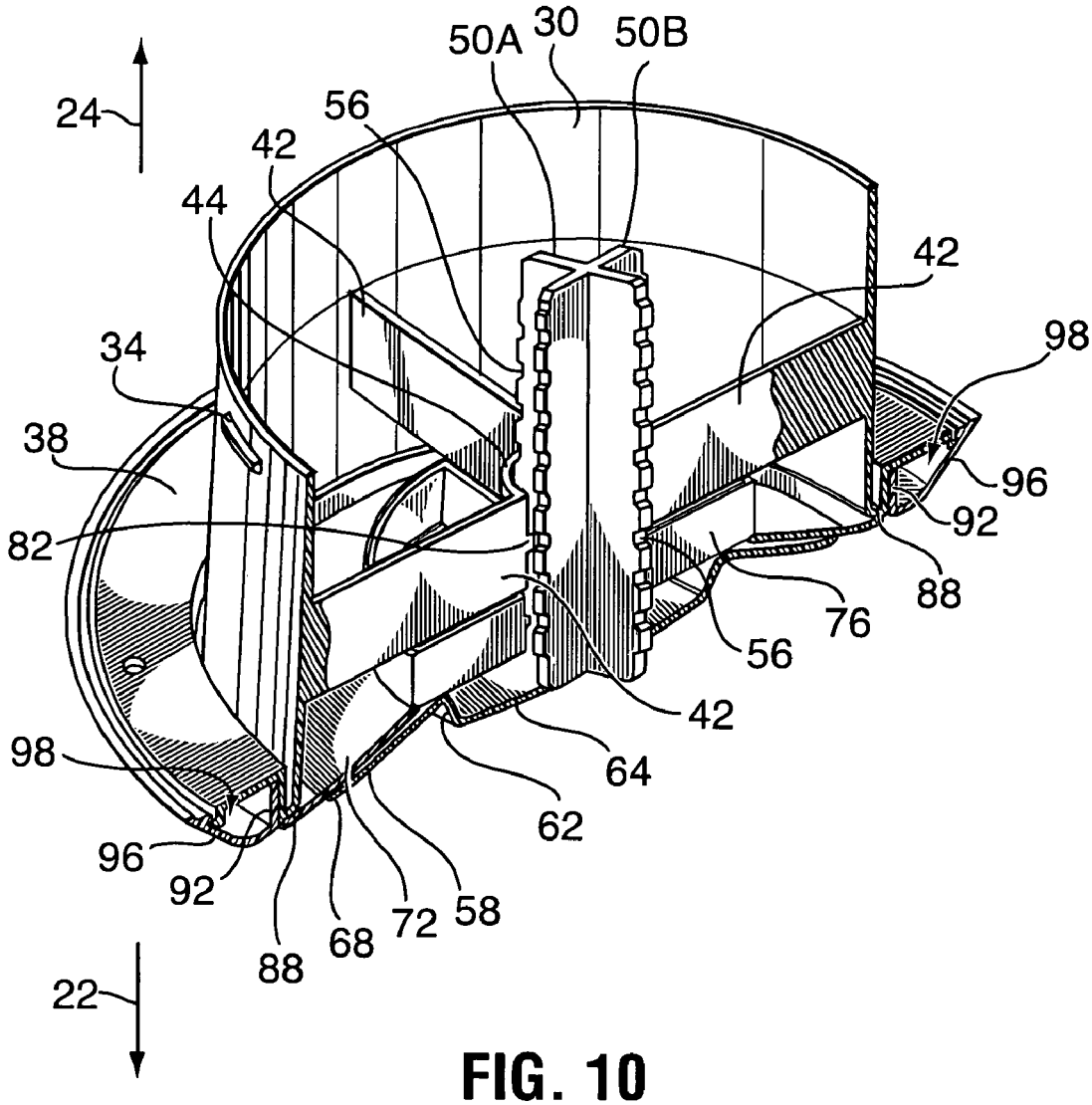
FIG. 10 is a sectioned isometric view of the FIG. 1 vent.

In the illustrated embodiment, as shown best in FIG. 10, body member 12 comprises a generally "U-shaped" bent portion 88, which is located around an exterior perimeter of first flange 30 at an outward end thereof. Bent portion 88 connects first flange 30 to exteriorly extending mounting flange 38. First flange 30 may have different shapes and/or sizes and mounting flange 38 may have different shapes and/or sizes. Accordingly, those skilled in the art will appreciate that bent portion 88 may also have different configurations, depending on the shapes and sizes of first flange 30 and mounting flange 38. For example, first flange 30 may be circular in cross-section and mounting flange 38 may be rectangular in cross-section. In such an embodiment, bent portion 88 has a different shape to form a transition between first flange 30 and mounting flange 38. In other embodiments, bent portion 88 is not provided and mounting flange 38 extends directly from an exterior surface of first flange 30.

Vent 10 may also comprise an optional trim member 18 (shown best in FIGS. 8, 9 and 10), which is coupleable to body member 12 (or to some other component of vent 10). Trim member 18 extends over at least a portion of an outward surface of mounting flange 38 at a distance spaced-apart therefrom. Trim member 18 may be used to cover portions of fasteners that extend on the outward side of mounting flange 38.

Figure 8:
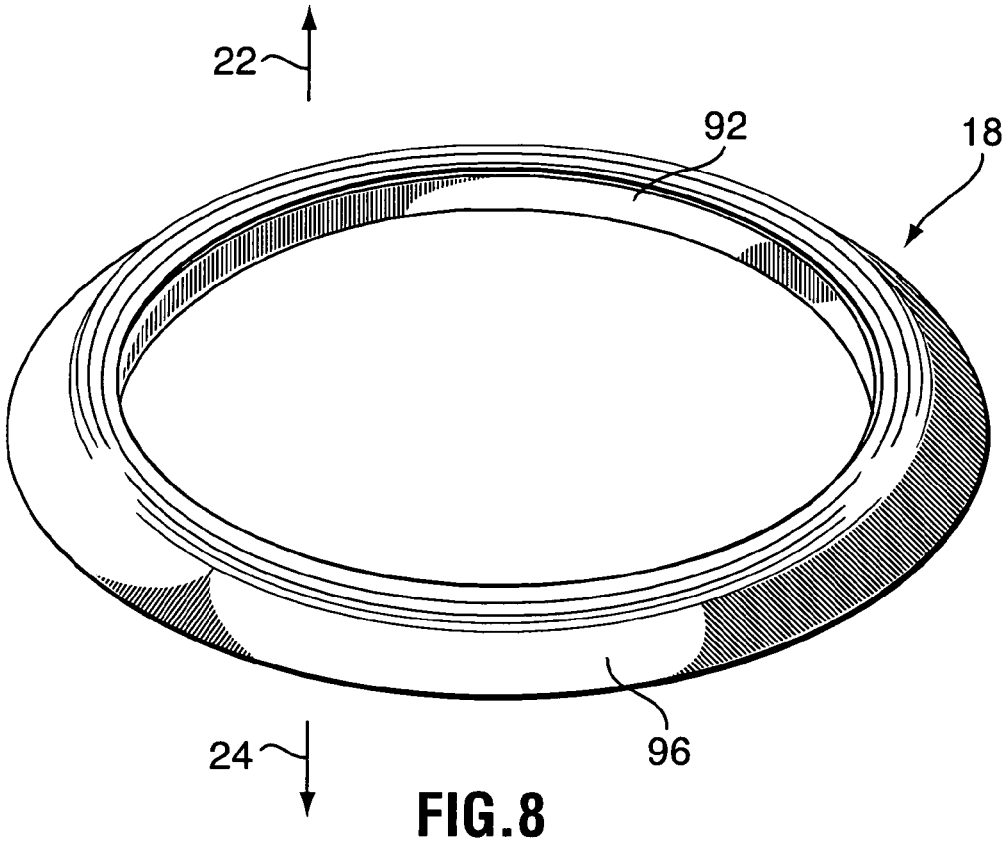
FIG. 8 is an isometric view of a trim member of the FIG. 1 vent.
Figure 9:
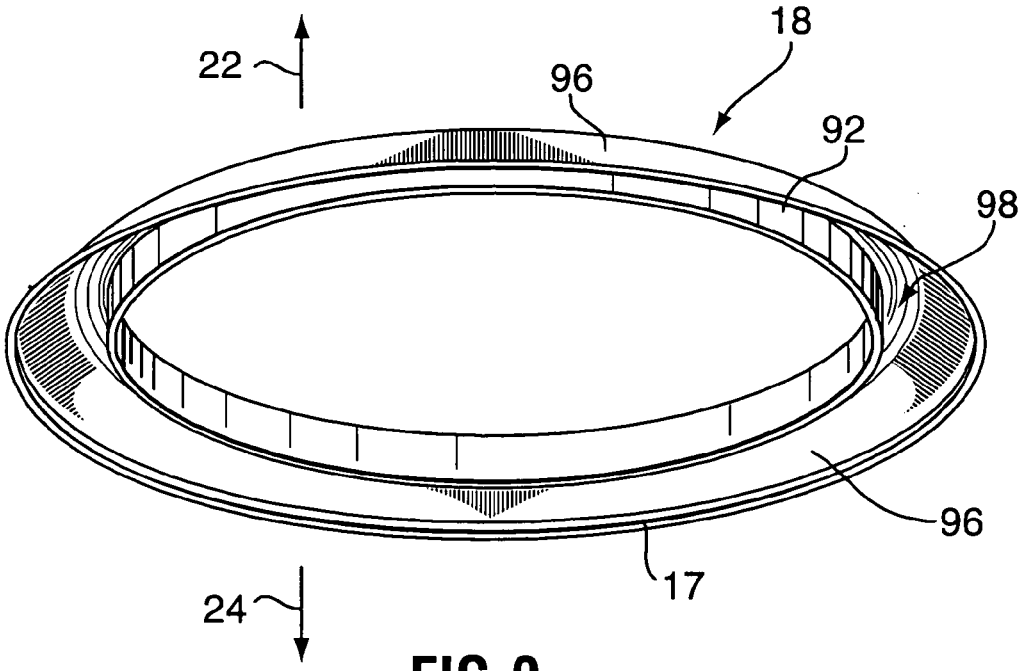
FIG. 9 is an isometric view of the trim member of FIG. 8 from a different perspective.

In the embodiment illustrated in FIGS. 8, 9 and 10, trim member 18 is generally annular in shape and comprises an inwardly extending portion 92 and a flange portion 96. Inwardly extending portion 92 of trim member 18 is shaped to conform with an exterior surface of bent portion 88. Flange portion 96 of trim member 18 extends generally exteriorly and inwardly from an outward end of inwardly extending portion 92 to form a trim member channel 98. Trim member channel 98 is located between an interior surface of flange portion 96 and an exterior surface of inwardly extending portion 92.

Figure 13:
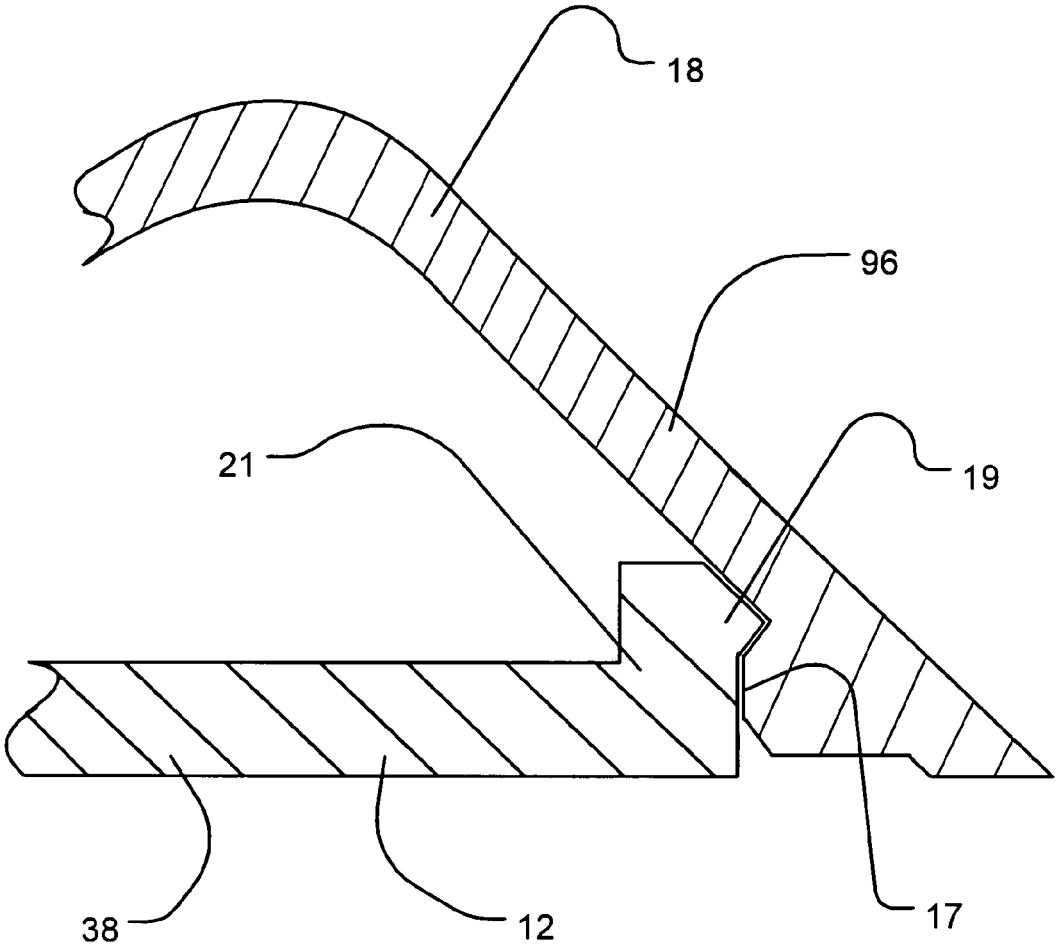
FIG. 13 is a cross-sectional view showing one possible mechanism for coupling the trim member of FIG. 8 to the body member of FIG. 3.

In accordance with one particular embodiment shown best in FIG. 13, body member 12 comprises an outwardly projecting rim 21 which may be used to help couple trim member 18 to body member 12. In the illustrated embodiment, rim 21 extends outwardly from an outer surface of mounting flange 38 and is located at an exterior perimeter of mounting flange 38. Rim 21 comprises an exteriorly projecting lip 19. Preferably, exterior projecting lip 19 is shaped to conform with the interior surface of flange portion 96 of trim member 18. In alternative embodiments, lip 19 may comprise a plurality of spaced apart protrusions rather than a lip extending all of the way around rim 21. The interior surface of flange portion 96 of trim member 18 comprises a corresponding interiorly projecting lip 17 at an inward end thereof. Preferably, interiorly projecting lip 17 is shaped to conform with an exterior surface of rim 21.

With this configuration, trim member 18 may be coupled to body member 12 by pushing trim member 18 inwardly over body member 12, such that the interiorly projecting lip 17 of trim member 18 is received on an inward side of the exteriorly projecting lip 19 of body member 12. Interiorly projecting lip 17 then abuts against the exterior surface of rim 21 and exteriorly projecting lip 19 abuts against the interior surface of flange portion 96. Interiorly projecting lip 17 (and trim member 18) are secured in place (i.e. prevented from moving outwardly) by exteriorly projecting lip 19.

Coupling trim member 18 and body member 12 may involve resiliently deforming trim member 18 and/or body member 12 to form a "snap together" fit, wherein trim member 18 is securely but removably coupled to body member 12.

Advantageously, trim member 18 may be coupled to body member 12 after body member 12 is already mounted to building surface 20. As discussed above, fasteners may project through apertures 40 and/or other portions of mounting flange 38 and into building surface 20. When trim member 18 is coupled to body member 12, trim member channel 98 provides room for the heads (or the other parts) of the fasteners, which may extend outwardly from mounting flange 38. In this manner, trim member 18 covers the fasteners used to mount vent 10, providing vent 10 with a more aesthetically pleasing appearance and providing some protection for the fasteners.

Figure 11A:
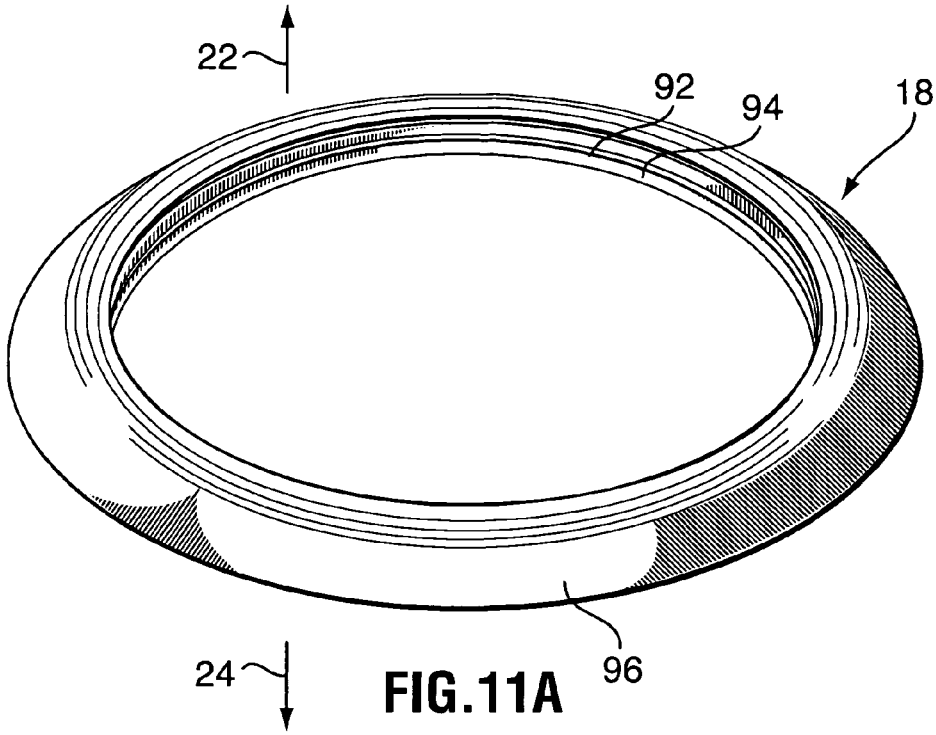
FIGS. 11A and 11B are respectively isometric views of a trim member and a body member of a vent according to another embodiment of the invention.
Figure 11B:
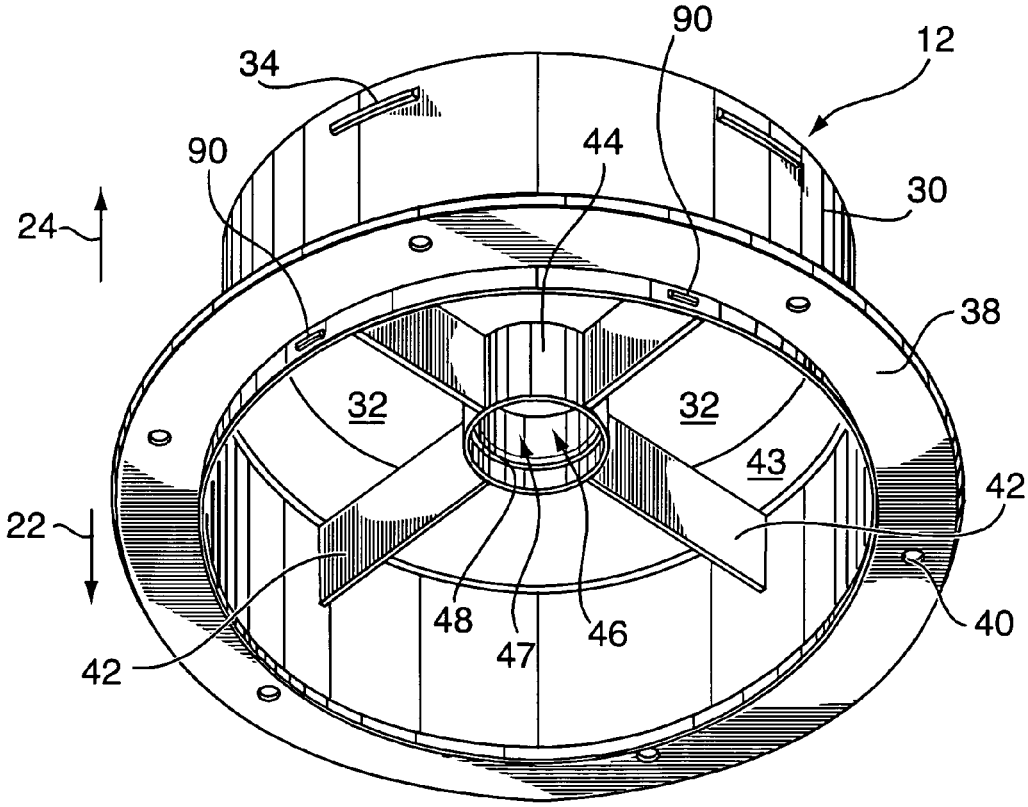

Those skilled in the art will appreciate that interiorly projecting lip 17 and exteriorly projecting lip 19 represent only one of many possible ways in which trim member 18 may be coupled to body member 12. One possible alternative embodiment is shown in FIGS. 11A and 11B, which respectively depict an alternative trim member 18 and an alternative body member 12. In the embodiment of FIGS. 11A and 11B, the exterior surface of bent portion 88 comprises a plurality of projections 90 at spaced-apart locations around its perimeter. Inwardly extending portion 92 of trim member 18 comprises a corresponding groove 94 on its interior surface. Trim member 18 is preferably resiliently deformable such that it may be pushed inwardly over body portion 12 and projections 90 may be received in groove 94 to form a "snap together" fit.

In still other embodiments, trim member 18 is coupled to body member 12 by other means, such as by threadable coupling(s) and/or other types of deformable grooves, projections, indents and/or surfaces, for example. Inwardly extending portion 92 and/or flange portion 96 of trim member 18 may be coupled to an outward end of first flange 30, to bent portion 88 and/or to mounting flange 38 of body member 12. As discussed above, first flange 30, bent portion 88 and mounting flange 38 may have different shapes and/or sizes. Similarly, trim member 18 may have different shapes and/or sizes to facilitate coupling to various components of vent 10.

Figure 5:
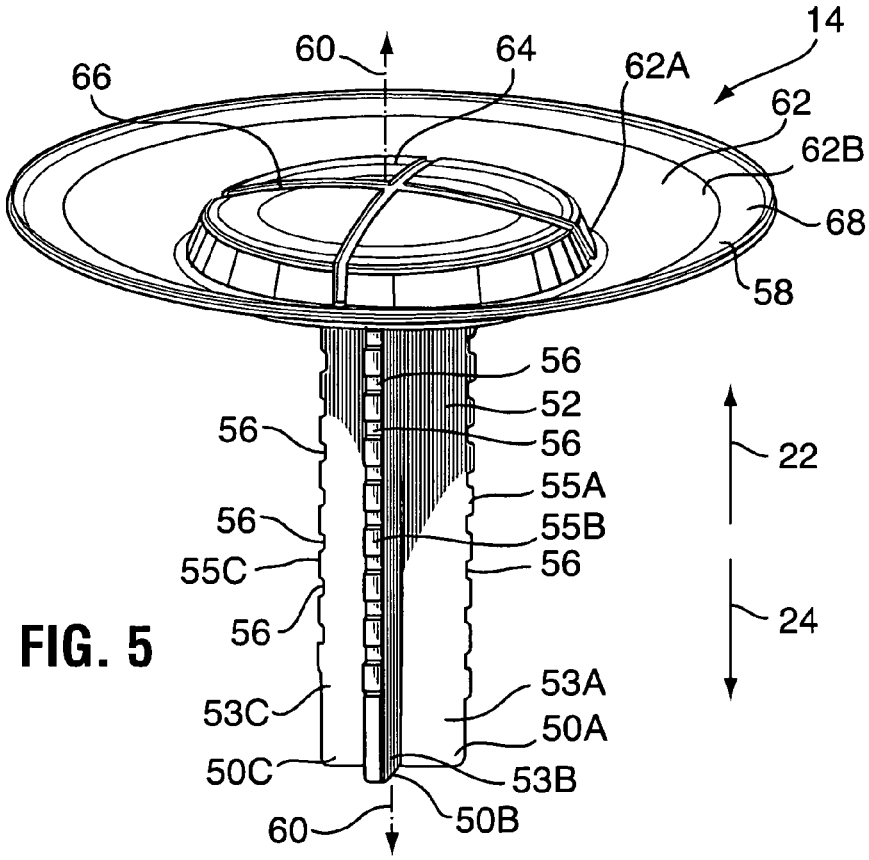
FIG. 5 is an isometric view of an adjustment member of the FIG. 1 vent.

In the embodiment illustrated in FIGS. 1–10, exteriorly extending head 58 of adjustment member 14 has a contoured shape comprising an outwardly projecting central portion 64, an intermediate portion 62 and an exterior portion 68 (see FIG. 5). Outwardly projecting central portion 64 (or other portions of head 58) may optionally comprise grooves 66, which may help users to rotate adjustment member 14 by providing a place where users may engage a tool, their hands and/or their fingers to rotate adjustment member 14. In other embodiments, grooves 66 may be replaced and/or augmented with outwardly projecting tabs and/or indents having different shapes. In the illustrated embodiment, intermediate portion 62 extends sharply inwardly from central portion 64 in region 62A and then extends gradually outwardly and exteriorly in region 62B until it reaches exterior portion 68. Exterior portion 68 extends even more gradually outwardly as it extends exteriorly from intermediate portion 62.

In the embodiment illustrated in FIGS. 1–10, intermediate member 16 also comprises a second intermediate flange 72 which extends generally exteriorly from inwardly extending first intermediate flange 70. Preferably, second intermediate flange 72 extends exteriorly at least as far as an interior edge of first flange 30 of body member 12. As shown best in FIG. 10, when intermediate member 16 is adjusted to an inward position, an exterior portion of second intermediate flange 72 contacts an outward surface of bent portion 88 of body member 12. When second intermediate flange 72 contacts the outward surface of bent portion 88, opening 86 (FIG. 1A) is substantially closed and only a minimal amount of air flow is permitted between second intermediate flange 72 and bent portion 88. In other embodiments, second intermediate flange 72 may be sized and/or shaped such that when intermediate member 16 is adjusted to an inward position, an exterior portion of second intermediate flange 72 contacts one or more of: first flange 30 of body member 12, bent portion 88 of body member 12, mounting flange 38 of body member 12 and/or flange portion 96 of trim member 18.

In embodiments comprising optional intermediate member 16, head 58 of adjustment member 14 is preferably sized such that it extends in the exterior direction at least as far as an interior edge of second intermediate flange 72. When adjustment member 14 is adjusted to an inward position relative to intermediate member 16, the exterior portion 68 and/or the intermediate portion 62B of head 58 contacts an outward surface of second intermediate flange 72, such that opening 84 (FIG. 1A) is substantially closed and only a minimal amount of air flow is permitted between head 58 of adjustment member 14 and second intermediate flange 72 of intermediate member 16.

Accordingly, in the embodiment illustrated in FIGS. 1–10, vent 10 can be adjusted from a minimum air flow configuration by rotating adjustment member 14 to an inward position, where head 58 of adjustment member 14 abuts against second intermediate flange 72 of intermediate member 16, and by rotating intermediate member 16 to an inward position, where second intermediate flange 72 abuts against bent portion 88 of body member 12. If air flow is desired, then adjustment member 14 may be rotated, such that head 58 of adjustment member 14 moves outwardly relative to second intermediate flange 72 to permit air flow into and out of intermediate vent passageway 74 and vent passageway 32 through opening 84. Adjustment member 14 may be rotated to move inwardly or outwardly to control the size of opening 84. If more air flow is desired, then adjustment member 14 and intermediate member 16 may be rotated together relative to body member 12, such that second intermediate flange 72 moves outwardly relative to bent portion 88 to permit air flow into and out of vent passageway 32 through opening 86. Thereafter, the air flow may be controlled by rotating adjustment member 14, intermediate member 16 and/or body member 12 relative to one another as discussed above to control the size of openings 84, 86.

In preferred embodiments of the invention, the components of vent 10 (including body member 12, adjustment member 14, optional intermediate member 16 and optional trim member 18) are fabricated from plastic. These plastic components of vent 10 may be injection molded using one or more molds. In alternative embodiments, one or more of the components of vent 10 or parts of the components of vent 10 are fabricated from other suitable materials, such as aluminum, steel or other metals, for example. In addition, the components of vent 10 may be fabricated using techniques other than injection molding, such as blow molding, rotational molding, spin casting and/or conventional machining techniques, for example.

As will be apparent to those skilled in the art in the light of the foregoing disclosure, many alterations and modifications are possible in the practice of this invention without departing from the spirit or scope thereof. For example:

In the embodiments illustrated in FIGS. 1–11B, collar passageway 47 (i.e. the interior surface of collar 44) is circular in cross-section and comprises threads 48 to define a threaded bore 46. With this configuration, adjustment member 14 may be threadably coupled to body member 12. In general, only the interior surfaces of collar 44 is required to be circular in cross-section. In alternative embodiments, threaded bore 46 may be provided by a component of any shape, which is penetrated by a bore having a generally circular cross-section.

In some embodiments, the interior surface of collar 44 is not threaded and contact portion(s) 55 of stem portions 53 engage the interior surface of collar 44 using other techniques, such as slidable frictional engagement. In such embodiments, the interior surface of collar 44 may be, but need not be, circular in cross-section.

Figure 12A:
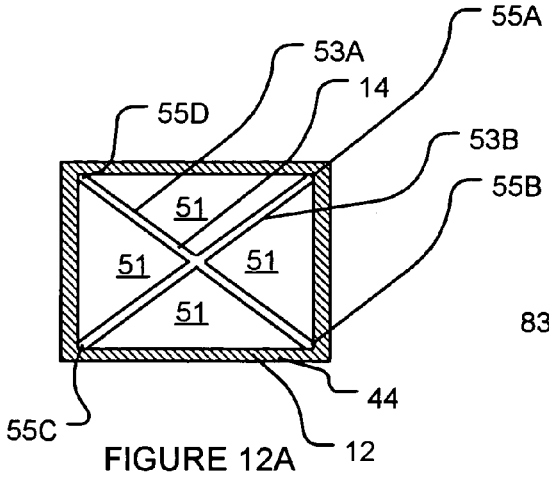
FIGS. 12A–12H are schematic partial cross-sectional views of adjustment member stem portions and body member collars of vents according to alternative embodiments of the invention.
Figure 12B:
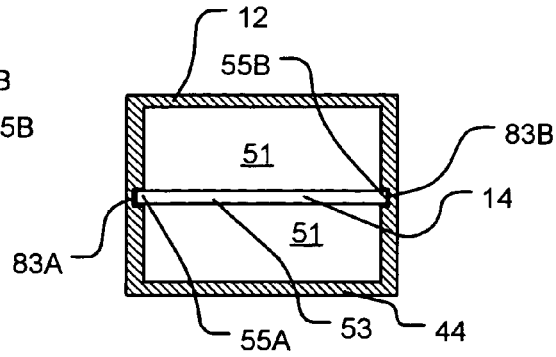
Figure 12C:
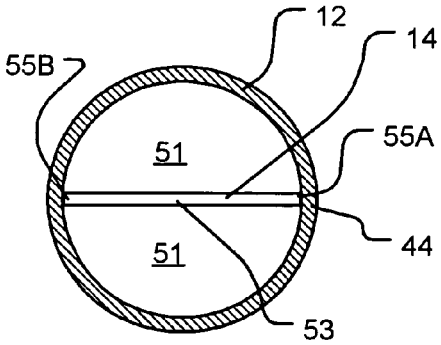
Figure 12D:
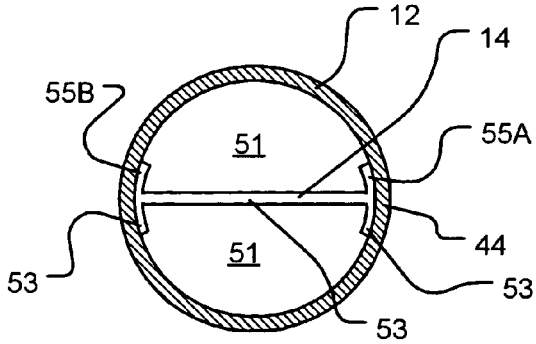
Figure 12E:
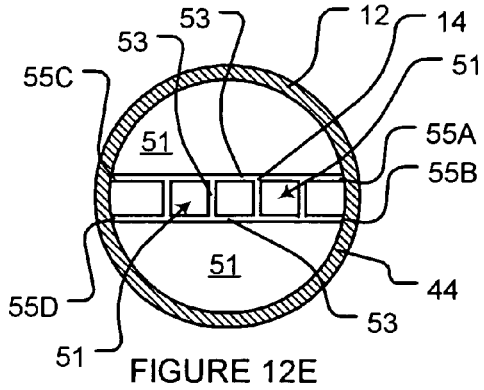
Figure 12F:
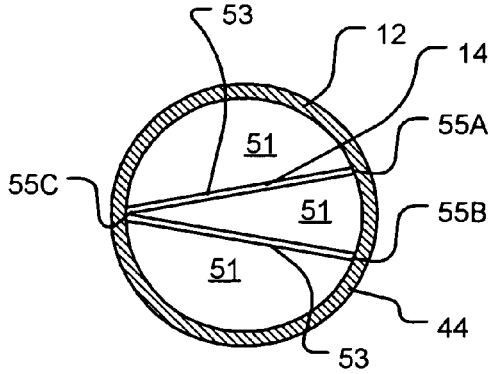
Figure 12G:
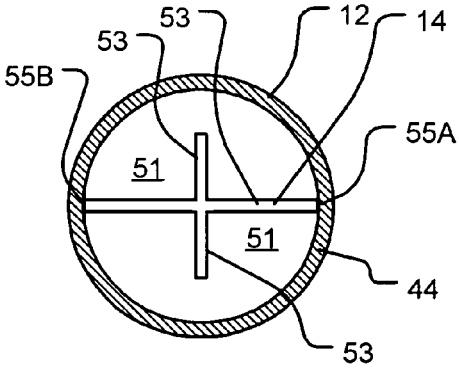
Figure 12H:
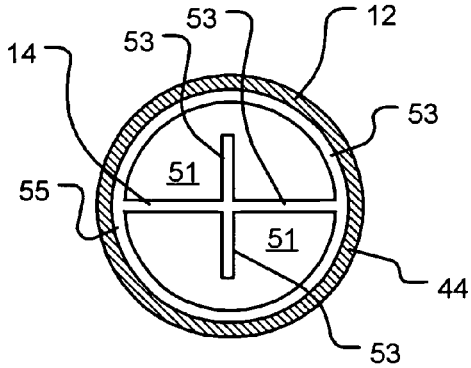

FIG. 12A is a partial schematic cross-sectional view of a collar 44 of body member 12 and stem portions 53A, 53B (collectively 53) of adjustment member 14 according to an alternative vent embodiment. In the embodiment of FIG. 12A, the interior surface of collar 44 is rectangular in cross-section. Stem portions 53 comprise contact portions 55A, 55B, 55C, 55D (collectively 55) that slidably frictionally engage the interior surface of collar 44 at the corners thereof. The engagement between contact portions 55 and the interior surface of collar 44 permits adjustment member 14 to be slidably moved inwardly and outwardly relative to body member 12. FIG. 12B schematically depicts a partial cross-sectional view of a collar 44 of body member 12 and stem portion 53 of adjustment member 14 according to another alternative vent embodiment. In the embodiment of FIG. 12B, the interior surface of collar 44 is rectangular in cross-section and comprises a pair of inwardly extending grooves 83A, 83B. Contact portions 55A, 55B of stem portion 53 are received in grooves 83A, 83B for slidable frictional engagement therewith to permit inward and outward movement of adjustment member 14 relative to body member 14. The embodiments of FIGS. 12A and 12B are merely representative examples of slidable frictional engagement between adjustment member 14 and body member 12. Those skilled in the art will appreciate that slidable frictional engagement between adjustment member 14 and body member 12 may be provided by a variety of alternative configurations of stem portions 53 and collars 44. For example, collar 44 may be circular in cross-section and still facilitate slidable friction engagement. In another example, contact portions 55 of stem portions 53 may comprise inwardly extending grooves which receive corresponding projections from the interior surface of collar 44 and still facilitate slidable frictional engagement.

In the embodiment illustrated in FIGS. 1–10, collar 44 is located in vent passageway 32. In general, brackets 42 may extend inwardly or outwardly such that collar 44 is not located in vent passageway 32.

In the embodiment illustrated in FIGS. 1–10, stem portions 53 comprise blades 50 which extend radially outwardly and which comprise contact portions 55 at their exterior ends for engaging the interior surface of collar 44 at angularly spaced-apart locations. This configuration is not generally necessary. FIGS. 12C–12H show non-limiting examples of partial cross-sectional views of stem portion(s) 53 of adjustment member 14 and collar 44 of body member 12 according to other possible embodiments. In each case, stem portion(s) 53 define one or more collar openings 51 on the interior surface of collar 44 (i.e. in collar passageway 47). Stem portion(s) 53 may define collar opening (s) 51 between two or more stem portions 53 and/or between one or more stem portions 53 and the interior surface of collar 44. In each case, stem portion(s) 53 comprise one or more contact portions 55 which adjustably engage the interior surface of collar 44. However, it is not necessary that there be a one to one correspondence between stem portions 53 and contact portions 55. In some embodiments, one or more stem portions 53 do not have a contact portion 55. In some embodiments, a single stem portion 53 may have a plurality of contact portions 55. The engagement between contact portions 55 and the interior surface of collar 44 may comprise threadable engagement, slidable frictional engagement or other forms of adjustable engagement. Those skilled in the art will appreciate that the embodiments shown in FIGS. 12C–12H are merely representative examples and that many other different configurations of stem portions 53 and collars 44 are possible.

Some alternative embodiments lack a separate collar 44. In such embodiments, stem portions 53 of adjustment member 14 may engage the interior surface of first flange 30.

All of the alternative embodiments and variations of collar 44 and stem portions 53 described above may also be applied to intermediate member collar 78.

In some embodiments, vent 10 comprises more than one intermediate member 16. Each intermediate member 16 is coupled between adjustment member 14 and body member 12 in substantially the same manner as in the above-described embodiment having one intermediate member.

In some embodiments, there is no need for trim member 18. For example, fasteners used to mount vent 10 to building surface 20 may be left uncovered. In an alternative example, body member 12 may be designed to receive fastener covering plugs in specific locations, such that fasteners may project through mounting flange 38 and then subsequently be covered by such plugs.

The embodiments described above describe the flow of air through vent 10. Those skilled in the art will appreciate that other fluids may flow through vent 10 and that solid and/or liquid matter may be suspended in air (or other fluids) that flow through vent 10.

Accordingly, the scope of the invention is to be construed in accordance with the substance defined by the following claims.

What is claimed is:

1. A vent comprising:

a body member comprising:

a vent passageway that extends from an inward side to an outward side of the body member; and a collar having a collar passageway that extends from an inward side to an outward side of the collar, the collar passageway in fluid communication with the vent passageway; and an adjustment member comprising a head disposed to adjustably restrict a flow of air through the vent passageway and a stem, the stem having one or more stem portions, the one or more stem portions comprising one or more contact portions which engage an interior surface of the collar and which moveably couple the adjustment member to the collar and wherein the one or more stem portions, alone or in combination with the interior surface of the collar, define a plurality of collar openings that extend through the collar passageway to permit airflow therethrough.

2. A vent according to claim 1 wherein a position of the adjustment member is adjustable relative to the body member to adjustably restrict a flow of air through the vent passageway.

3. A vent according to claim 1 wherein at least a portion of the flow of air through the vent passageway flows through the plurality of collar openings.

4. A vent according to claim 1 wherein at least one of the plurality of collar openings is completely defined between at least one stem portion and the interior surface of the collar.

5. A vent according to claim 1 wherein at least one of the plurality of collar openings is completely defined between a plurality of stem portions.

6. A vent according to claim 1 wherein inward movement of the adjustment member relative to the body member decreases a size of an opening through which air may flow into and out of the vent passageway and outward movement of the adjustment member relative to the body member increases the size of the opening through which air may flow into and out of the vent passageway.

7. A vent according to claim 1 wherein the one or more stem portions comprise one or more blades, each blade comprising at least one surface and at least one exterior edge having a dimension smaller than a dimension of the at least one surface and wherein the one or more contact portions are substantially defined by the exterior edges of the one or more blades which engage the interior surface of the collar at spaced apart locations.

8. A vent according to claim 1 wherein the one or more contact portions slidably frictionally engage the interior surface of the collar.

9. A vent according to claim 1 wherein the interior surface of the collar comprises one or more projections and wherein the one or more contact portions comprise at least one inwardly extending groove which slidably receives the one or more projections.

10. A vent according to claim 1 wherein the body member comprises one or more brackets for supporting the collar in the vent passageway.

11. A vent according to claim 1 wherein the body member comprises a mounting flange for coupling the body member to a building surface.

12. A vent according to claim 11 wherein, when the vent is mounted to the building surface, a plurality of fasteners project through the mounting flange and into the building surface.

13. A vent according to claim 12 comprising a trim member that is removably coupleable to the body member, wherein, when the trim member is coupled to the body member, the trim member extends over an outward surface of the mounting flange at a distance spaced outwardly therefrom.

14. A vent according to claim 13 wherein the trim member covers an outward side of any portions of the plurality of fasteners which extend outwardly past the outward surface of the mounting flange.

15. A vent according to claim 13 wherein the trim member is shaped to define a channel and wherein, when the trim member is coupled to the body member, the channel opens inwardly onto the outward surface of the mounting flange such that any portions of the plurality of fasteners which extend outwardly past the outward surface of the mounting flange are located in the channel.

16. A vent according to claim 1 comprising a trim member that is removably coupleable to the body member, wherein, when the trim member is coupled to the body member, the trim member covers outward ends of one or more fasteners used to mount the vent to a building surface.

17. A vent according to claim 16 wherein the trim member comprises an interiorly projecting lip and the body member comprises an exteriorly projecting lip and wherein, when the trim member is coupled to the body member, the interiorly projecting lip of the trim member is received on an inward side of the exteriorly projecting lip of the body member.

18. A vent according to claim 16 wherein the trim member comprises at least one groove and the body member comprises at least one projection and wherein, when the trim member is coupled to the body member, the at least one projection is received in the at least one groove.

19. A vent comprising:

a body member comprising:

a vent passageway that extends from an inward side to an outward side of the body member; and a collar having a collar passageway that extends from an inward side to an outward side of the collar, the collar passageway in fluid communication with the vent passageway; and an adjustment member comprising a head disposed to adjustably restrict a flow of air through the vent passageway and a stem, the stem having one or more stem portions, the one or more stem portions comprising one or more contact portions which engage an interior surface of the collar and which moveably couple the adjustment member to the body member and the one or more stem portions, alone or in combination with the interior surface of the collar, defining one or more collar openings that extend through the collar passageway wherein the one or more stem portions comprise one or more blades and wherein the one or more contact portions comprise a plurality of contact portions that engage the interior surface of the collar at spaced-apart locations and wherein the one or more blades comprise a plurality of blades which extend radially in angularly spaced-apart directions.

20. A vent according to claim 19 wherein the angularly spaced-apart directions are equally spaced from one another.

21. A vent comprising:

a body member comprising:

a vent passageway that extends from an inward side to an outward side of the body member; and a collar having a collar passageway that extends from an inward side to an outward side of the collar, the collar passageway in fluid communication with the vent passageway; and an adjustment member comprising a head disposed to adjustably restrict a flow of air through the vent passageway and a stem, the stem having one or more stem portions, the one or more stem portions comprising one or more contact portions which engage an interior surface of the collar and which moveably couple the adjustment member to the body member and the one or more stem portions, alone or in combination with the interior surface of the collar, defining one or more collar openings that extend through the collar passageway wherein the interior surface of the collar is generally circular in cross-section and comprises one or more helical threads.

22. A vent according to claim 21 wherein the one or more contact portions comprise at least one contact portion that has one or more indents for engaging the one or more helical threads.

23. A vent according to claim 22 wherein rotating the adjustment member relative to the body member in a first angular direction causes corresponding inward movement of the adjustment member relative to the body member and a corresponding decrease in a size of an opening through which air may flow into and out of the vent passageway and rotating the adjustment member relative to the body member in a second angular direction causes corresponding outward movement of the adjustment member relative to the body member and a corresponding increase in the size of the opening through which air may flow into and out of the vent passageway.

24. A vent according to claim 21 wherein the one or more stem portions comprise one or more blades, wherein the one or more contact portions comprise a plurality of contact portions that engage the interior surface of the collar at spaced-apart locations and wherein the one or more contact portions comprise at least one contact portion that has one or more indents for engaging the one or more helical threads.

25. A vent according to claim 24 wherein the one or more blades comprise a plurality of blades which extend radially in angularly spaced-apart directions.

26. A vent comprising:

a body member comprising:

a vent passageway that extends from an inward side to an outward side of the body member; and a collar having a collar passageway that extends from an inward side to an outward side of the collar, the collar passageway in fluid communication with the vent passageway; and an adjustment member comprising a head disposed to passageway and a stem, the stem having one or more stem portions, the one or more stem portions comprising one or more contact portions which engage an interior surface of the collar and which moveably couple the adjustment member to the body member and the one or more stem portions, alone or in combination with the interior surface of the collar, defining one or more collar openings that extend through the collar passageway, wherein the interior surface of the collar comprises one or more inwardly extending grooves and wherein the one or more contact portions comprise at least one contact portion that is slidably received in each of the grooves.

27. A vent comprising:

a body member comprising:

a vent passageway that extends from an inward side to an outward side of the body member; and a collar having a collar passageway that extends from an inward side to an outward side of the collar, the collar passageway in fluid communication with the vent passageway;

an adjustment member comprising a head disposed to adjustably restrict a flow of air through the vent passageway and a stem, the stem having one or more stem portions, the one or more stem portions comprising one or more contact portions which engage an interior surface of the collar and which moveably couple the adjustment member to the body member and the one or more stem portions, alone or in combination with the interior surface of the collar, defining one or more collar openings that extend through the collar passageway; and at least one intermediate member that is coupled between the body member and the adjustment member, the intermediate member comprising an intermediate vent passageway that extends from an inward side to an outward side of the intermediate member and comprising an intermediate member collar having an intermediate collar passageway that extends from an inward side to an outward side of the intermediate member collar, the intermediate collar passageway in fluid communication with the intermediate vent passageway, wherein the one or more contact portions engage an interior surface of the intermediate member collar and adjustably couple the intermediate member between the adjustment member and the body member and wherein the one or more stem portions, alone or in combination with the interior surface of the intermediate member collar, define one or more intermediate collar openings that extend through the intermediate collar passageway.

28. A vent according to claim 27 wherein at least one intermediate collar opening is defined between at least one stem portion and the interior surface of the intermediate member collar.

29. A vent according to claim 27 wherein at least one collar opening is defined between a plurality of stem portions.

30. A vent according to claim 27 wherein a position of the intermediate member is adjustable relative to the adjustment member and the body member to adjustably restrict a flow of air through the vent passageway.

31. A vent according to claim 27 wherein the interior surface of the intermediate member collar is generally circular in cross-section and comprises one or more helical threads.

32. A vent according to claim 31 wherein the one or more contact portions comprise at least one contact portion that has one or more indents for engaging the one or more helical threads.

33. A vent according to claim 31 wherein the one or more stem portions comprise one or more blades, wherein the one or more contact portions comprise a plurality of contact portions that engage the interior surface of the intermediate member collar at spaced-apart locations and wherein the one or more contact portions comprise at least one contact portion that has one or more indents for engaging the one or more helical threads.

34. A vent according to claim 33 wherein the one or more blades comprise a plurality of blades which extend radially in angularly spaced-apart directions.

35. A vent according to claim 10 wherein the intermediate member comprises one or more spaced-apart brackets for supporting the intermediate member collar in the intermediate vent passageway.

36. A vent comprising:

a body member having a vent passageway which extends from an inward side to an outward side of the body member and a surface that defines a bore having a generally circular cross-section, the bore in fluid communication with the vent passageway; and an adjustment member comprising a head and a stem projecting inwardly from the head, the stem comprising a plurality of blades;

wherein exterior edges of the blades are disposed to moveably engage the bore defining surface and wherein the blades, alone or in combination with the bore defining surface, define a plurality of passages through the bore.

37. A vent comprising:

a body member having a vent passageway which extends from an inward side to an outward side of the body member and a surface that defines bore in fluid communication with the vent passageway; and an adjustment member comprising a head and a stem projecting inwardly from the head, the stem comprising a plurality of blades;

wherein exterior edges of the blades are disposed to engage the bore defining surface and wherein the blades, alone or in combination with the bore defining surface, define a plurality of passages through the bore and wherein the bore defining surface comprises one or more threads and the exterior edge of at least one of the blades comprise one or more indents for engaging the one or more threads.

38. A vent comprising:

a body member comprising:

a vent passageway that extends from an inward side to an outward side of the body member; and a collar having an interior surface that defines a collar passageway which is in fluid communication with the vent passageway;

an adjustment member comprising a head disposed to adjustably restrict a flow of air through the vent passageway and a stem that projects inwardly from the head, the stem having one or more stem portions, the one or more stem portions comprising one or more contact portions which moveably engage the interior surface of the collar and which couple the adjustment member to the body member, such that the stem projects inwardly into the collar passageway and the adjustment member is inwardly and outwardly moveable relative to the body member and is rotatable relative to the body member about an inwardly and outwardly extending axis;

wherein the one or more stem portions, alone or in combination with the interior surface of the collar, define one or more collar openings that extend through the collar passageway for permitting a flow of air through the collar passageway.

* * * * *